US011453928B2

(12) United States Patent
Tan

(10) Patent No.: US 11,453,928 B2
(45) Date of Patent: Sep. 27, 2022

(54) DEVICE AND METHOD FOR DETECTING HEATING TREATMENT TEMPERATURES OF DOUBLE STEEL WIRES

(71) Applicant: Guangzhou Lianrou Machinery & Equipment Co., Ltd., Guangzhou (CN)

(72) Inventor: Zhiming Tan, Guangzhou (CN)

(73) Assignee: Guangzhou Lianrou Machinery & Equipment Co., Ltd., Guangzhou (CN)

( * ) Notice: Subject to any disclaimer, the term of this patent is extended or adjusted under 35 U.S.C. 154(b) by 457 days.

(21) Appl. No.: 16/626,075

(22) PCT Filed: May 11, 2018

(86) PCT No.: PCT/CN2018/086526
§ 371 (c)(1),
(2) Date: Dec. 23, 2019

(87) PCT Pub. No.: WO2019/091078
PCT Pub. Date: May 16, 2019

(65) Prior Publication Data

US 2020/0199707 A1 Jun. 25, 2020

(30) Foreign Application Priority Data

Nov. 7, 2017 (CN) ..... 201711088143.2

(51) Int. Cl.
*C21D 11/00* (2006.01)
*C21D 9/02* (2006.01)
(Continued)

(52) U.S. Cl.
CPC ..... *C21D 11/00* (2013.01); *B21C 1/02* (2013.01); *B21C 51/00* (2013.01); *C21D 9/02* (2013.01)

(58) Field of Classification Search
CPC .. C21D 11/00; C21D 9/02; B21C 1/02; B21C 51/00; B21F 3/02; B21F 23/002; B21F 27/16; B21F 35/00
See application file for complete search history.

(56) References Cited

U.S. PATENT DOCUMENTS 4,991,277 A 2/1991 Itaya
2017/0348759 A1* 12/2017 Furuse ..... B21F 35/00

FOREIGN PATENT DOCUMENTS

CN 201320587 Y 10/2009
CN 106513547 A * 3/2017 ..... B21F 11/005
(Continued)

OTHER PUBLICATIONS

Supplementary European Search Report dated Jan. 14, 2021.
(Continued)

*Primary Examiner* — Rebecca Janssen
(74) *Attorney, Agent, or Firm* — Welsh Flaxman & Gitler LLC

(57) ABSTRACT

Disclosed are a device and method for detecting heating treatment temperatures of double steel wires. The temperature detection device includes a double wires coiling machine, two heating mechanisms for respectively heating two steel wires, and two temperature detection mechanisms for respectively detecting temperatures of the two steel wires in real time, and a controller electrically connected to the two heating mechanisms and the double-wire spring coiling machine respectively.

3 Claims, 4 Drawing Sheets

(51) Int. Cl.
*B21C 1/02* (2006.01)
*B21C 51/00* (2006.01)

(56) References Cited

FOREIGN PATENT DOCUMENTS

| | | | | | |
|---|---|---|---|---|---|
| CN | 106513547 | A | | 3/2017 | |
| CN | 206305224 | U | | 7/2017 | |
| CN | 206343575 | U | | 7/2017 | |
| JP | 2016155162 | A | * | 9/2016 | ..... B21F 3/06 |
| JP | 2016155162 | A | | 9/2016 | |
| WO | 2015/154463 | A1 | | 10/2015 | |

OTHER PUBLICATIONS

International Preliminary Report on Patentability dated May 12, 2020.
International Search Report dated Jul. 2018-2018.
European Search Opinion dated Jan. 14, 2021.

* cited by examiner

DEVICE AND METHOD FOR DETECTING HEATING TREATMENT TEMPERATURES OF DOUBLE STEEL WIRES

FIELD

The disclosure relates to the field of mattress spring production technologies, and more particularly, to a device and method for detecting heating treatment temperatures of double steel wires.

BACKGROUND

A mattress spring is usually subjected to heat treatment after coiling for the purpose of eliminating internal stress of a steel wire, such that the spring has a better resilience. Moreover, the stability of heat treatment of the spring directly affects the quality and durability of a mattress.

At present, there are more and more spring mattresses with soft and hard partitions in the market, which are usually made of springs of different steel wire diameters, that is, the steel wire diameters of the mattress spring in adjacent areas are different, thus causing different degrees of hardness and softness. In order to produce the mattress with soft and hard partitions more quickly, a coiling machine for double steel wires which is capable of coiling different springs with two types of steel wires at the same time appears in the prior art. However, the coiling machine needs to be continuously and frequently switched between the two types of steel wires, which improves the production efficiency on one hand, but on the other hand also causes uneven and unstable heat treatment on the spring, and the quality of the mattress is directly affected.

SUMMARY

The technical problem to be solved by the disclosure is to provide a device and method for detecting heating treatment temperatures of double steel wires, such that springs coiled with two types of steel wires are stably and uniformly heated.

The technical solution for solving the technical problem above is as follows.

There is provided in a first aspect of the disclosure a device for detecting heating treatment temperatures of double steel wires includes a double steel wires coiling machine, two heating mechanisms for respectively heating two steel wires, two temperature detection mechanisms for respectively detecting temperatures of the two steel wires in real time, and a controller electrically connected to the two heating mechanisms and the coiling machine respectively.

Further, each of the two temperature detection mechanisms includes a steel wire stabilizing member for controlling smooth movement and conveying of a steel wire and a temperature sensor for detecting a temperature of a steel wire.

Further, the steel wire stabilizing member comprises one of a positioning block with a through hole or a groove for a steel wire to pass through and a positioning wheel with a groove for a steel wire to pass through.

Further, the temperature sensor includes an infrared temperature sensor.

There is provided in a second aspect of the disclosure a method for detecting heating treatment temperatures of double steel wires, including the following steps of:

in case of switching from a first steel wire to a second steel wire, which are respectively coiled into a spring by a double steel wires coiling machine, controlling, by a controller, the coiling machine to suspend the first steel wire being coiled;

controlling, by the controller, a second heating mechanism to heat the second steel wire;

acquiring, by a second temperature detection mechanism, a temperature of the second steel wire in real time and feeding the temperature back to the controller; and in response to the temperature of the second steel wire reaching or exceeding a preset temperature, controlling, by the controller, the coiling machine to coil the second steel wire into a spring.

There is provided in a third aspect of the disclosure a method for detecting heating treatment temperatures of double steel wires, including the following steps of:

controlling, by a controller, a second heating mechanism to heat a second steel wire, while a first steel wire is being coiled into a spring by a double steel wires coiling machine, wherein the first steel wire and the second steel wire is coiled into a first spring and a second spring by the coiling machine respectively, acquiring, by a second temperature detection mechanism, a temperature of the second steel wire in real time and feeding the temperature back to the controller, such that the temperature of the second steel wire is always kept within a predetermined range, and in case of switching from the first steel wire to the second steel wire, controlling, by the controller, the coiling machine to directly switch from the first steel wire being coiled to the second steel wire and coil the second steel wire into a spring.

Further, the controlling, by a controller, a second heating mechanism to heat a second steel wire, includes:

in response to the temperature of the second steel wire detected by the second temperature detection mechanism reaching a preset temperature value A, controlling, by the controller, the second heating mechanism to suspend heating of the second steel wire, and in response to the temperature of the second steel wire detected by the second temperature detection mechanism being decreased to a preset temperature value B, activating, by the controller, the second heating mechanism to heat the second steel wire, such that the temperature of the second steel wire is always kept between the preset temperature value A and the preset temperature value B.

Further, the controlling, by a controller, a second heating mechanism to heat a second steel wire, includes:

adjusting and controlling, by the controller, an output current level of the second heating mechanism according to a temperature level of the second steel wire detected by the second temperature detection mechanism, such that the temperature of the second steel wire is always kept within a predetermined range.

Beneficial effects: in the device and method for detecting heating treatment temperatures of double steel wires, the temperatures of the two steel wires are acquired in real time by the two temperature detection mechanisms, and whether the first steel wire or the second steel wire is coiled into a spring by the double steel wires coiling machine, the steel wire shall reach the preset temperature, such that each spring produced continuously has the same heat treatment effect, and the production quality of the spring is ensured.

BRIEF DESCRIPTION OF THE DRAWINGS

The disclosure is further described below with reference to the drawings and the embodiments.

DETAILED DESCRIPTION OF THE EMBODIMENTS

Figure 1:
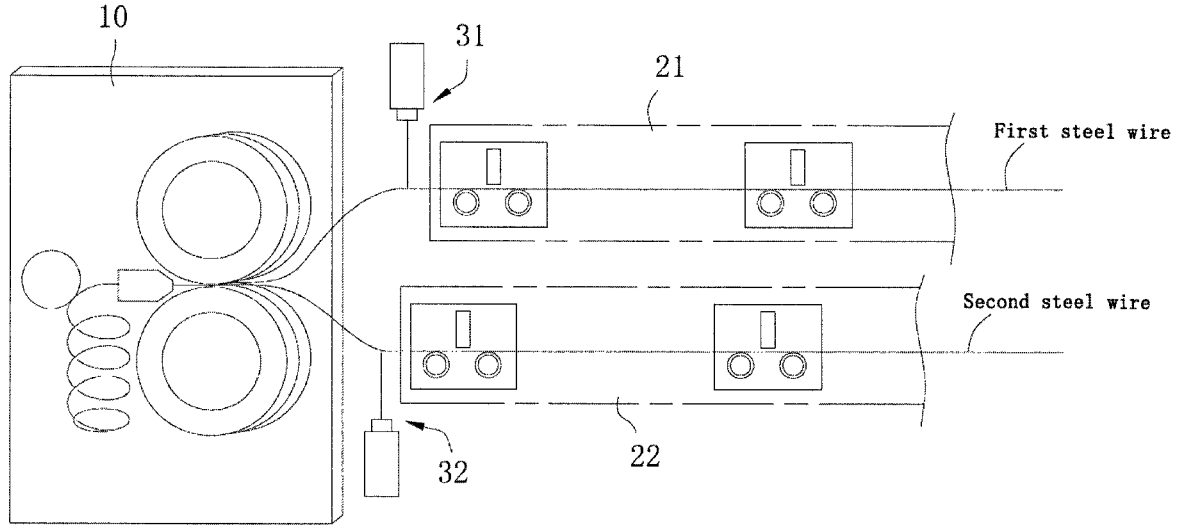
FIG. 1 is a structure diagram of the disclosure.
Figure 2:
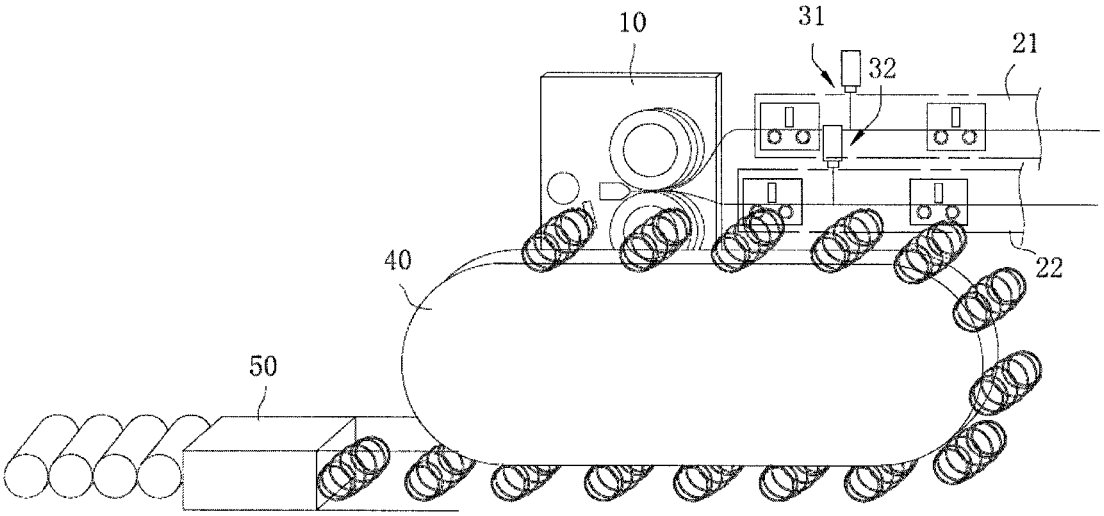
FIG. 2 is a structure diagram of the disclosure in a use state.

With reference to FIG. 1 and FIG. 2, a device for detecting heating treatment temperatures of double steel wires according to the disclosure includes a double steel wires coiling machine 10, a first heating mechanism 21 and a second heating mechanism 22 for respectively heating a first steel wire and a second steel wire, and a first temperature detection mechanism 31 and a second temperature detection mechanism 32 for respectively detecting temperatures of the first steel wire and the second steel wire in real time. The first heating mechanism 21 and the second heating mechanism 22 both heat the steel wires by energizing with two or more electrodes contacting the steel wires, and the coiling machine 10 coils a steel wire reaching a preset temperature into a spring and outputs the spring to a spring conveying mechanism 40, and the spring conveying mechanism 40 conveys the spring to a spring bagging mechanism 50 to wrap and package the spring into a bagged spring.

The coiling machine 10 can only coil one steel wire into one spring at a time, that is, when one of the steel wires is coiled, the other steel wire is in a standby state.

The first heating mechanism 21 and the second heating mechanism 22 are electrically connected to a controller, the coiling machine 10 is electrically connected to the controller, the controller can control operating states of the first heating mechanism 21 and the second heating mechanism 22 according to a feedback, and the controller can also control the coiling machine 10 to coil the first steel wire or the second steel wire.

The first temperature detection mechanism 31 and the second temperature detection mechanism 32 both include a steel wire stabilizing member 34 for controlling smooth movement and conveying of a steel wire and a temperature sensor 35 for detecting a temperature of a steel wire. The temperature sensor 35 is a non-contact temperature sensor and is preferably an infrared temperature sensor, and the temperature sensor 35 detects a temperature of a steel wire and feeds the temperature back to the controller in real time. The steel wire stabilizing member 34 can ensure smooth movement and conveying of a steel wire, such that the temperature sensor 35 can stably detect and acquire a temperature of the steel wire.

Figure 3:
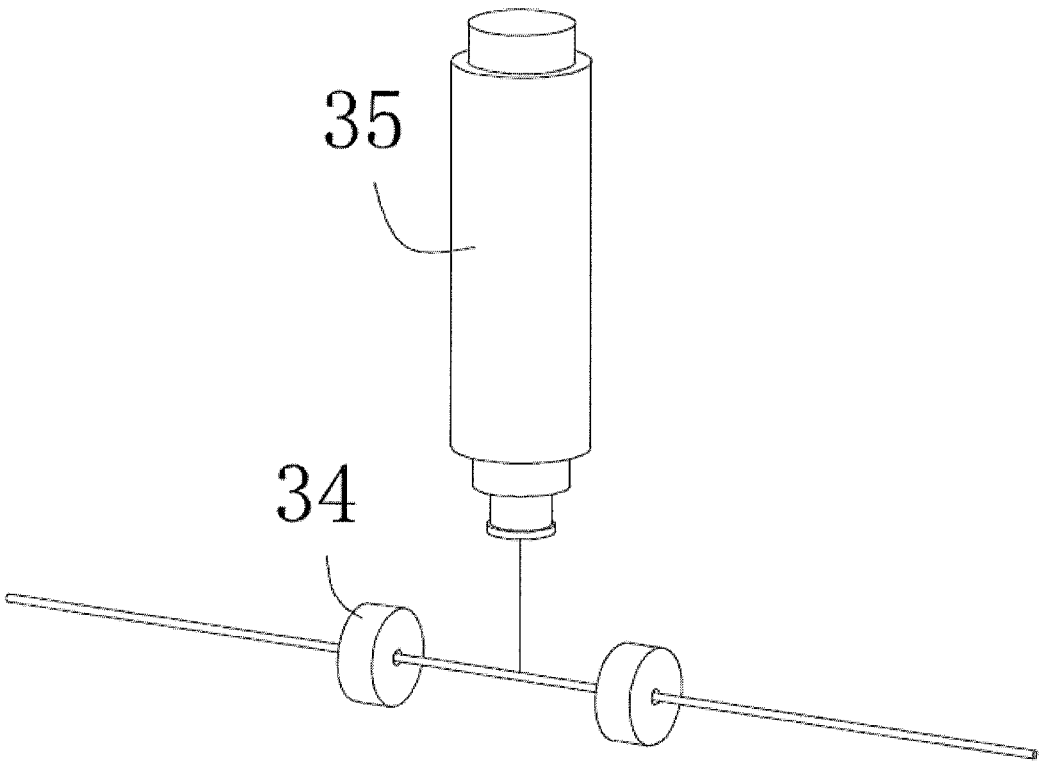
FIG. 3 is a structure diagram of a steel wire stabilizing member according to a first embodiment of the disclosure.
Figure 4:
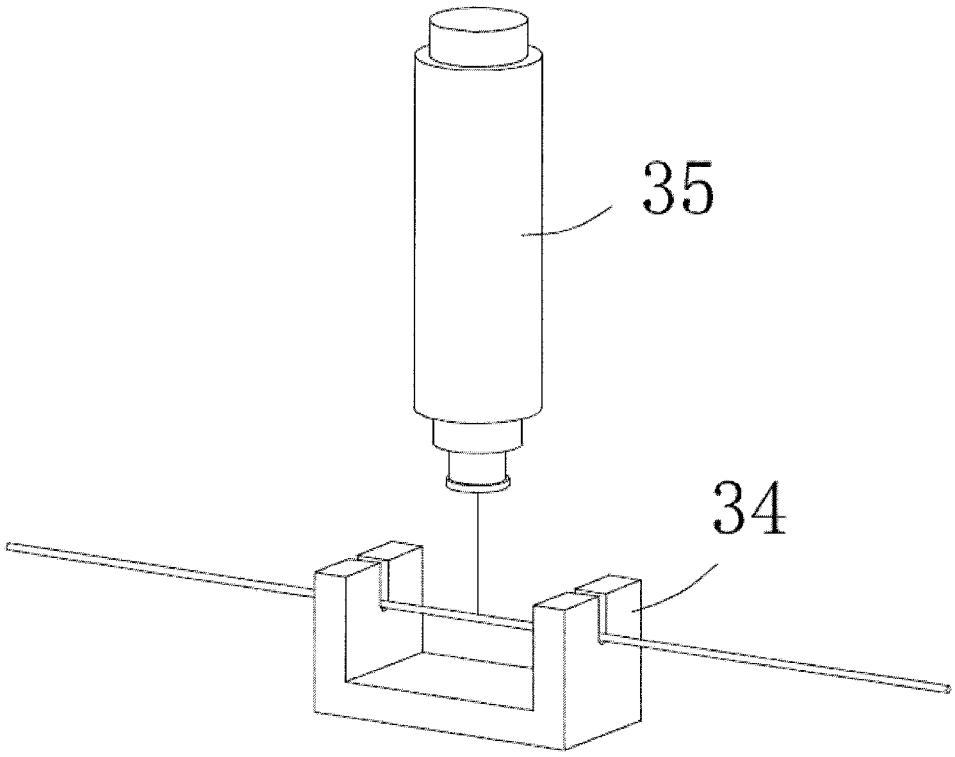
FIG. 4 is a structure diagram of a steel wire stabilizing member according to a second embodiment of the disclosure.
Figure 5:
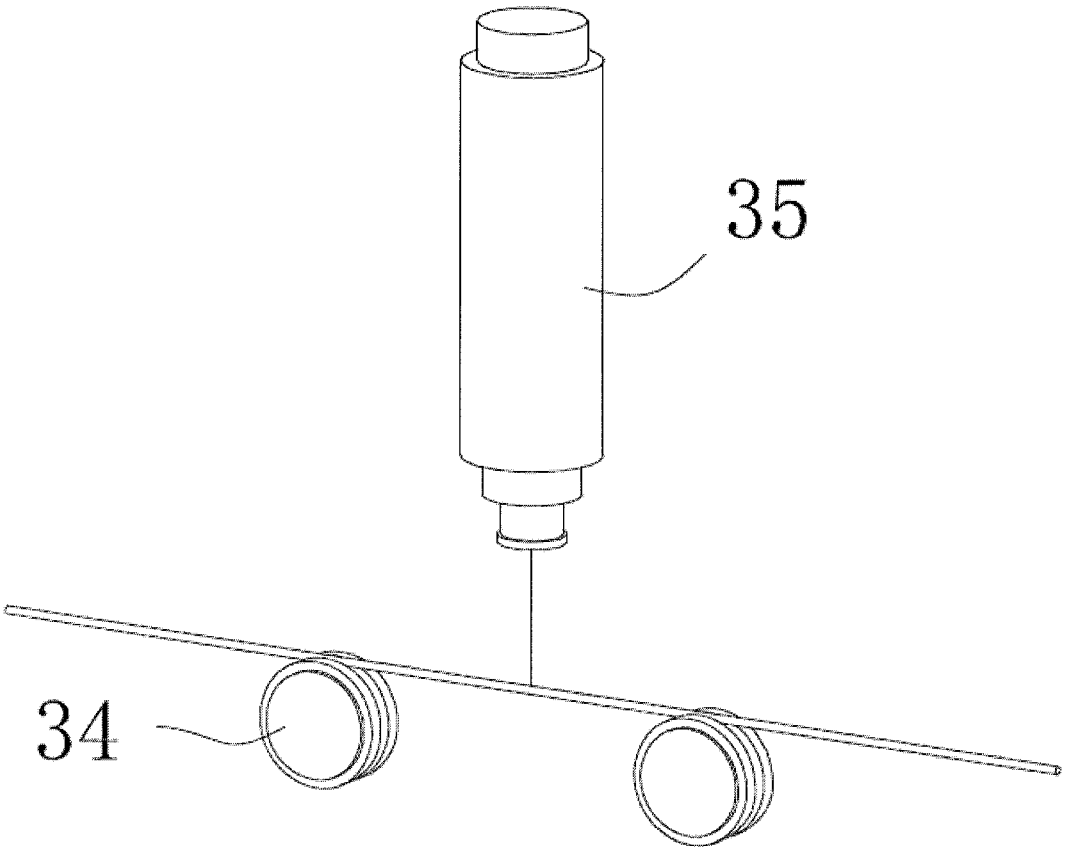
FIG. 5 is a structure diagram of a steel wire stabilizing member according to a third embodiment of the disclosure.

With reference to FIG. 3 to FIG. 5, the steel wire stabilizing member 34 may be the type of two positioning blocks each having a through hole or a groove through which a steel wire passes, such that the steel wire moves smoothly in this section, and the temperature sensor 35 is arranged in this section. Certainly, the steel wire stabilizing member 34 may also be the type of two positioning wheels each having a groove through which a steel wire passes, such that the steel wire moves smoothly in this section, and the temperature sensor 35 is arranged in this section. The steel wire stabilizing member 34 may have various structure forms, and is mainly used for controlling smooth movement and conveying of a steel wire and avoiding shaking.

The following two methods can be formed when the device for detecting heating treatment temperatures of double steel wires according to the disclosure is applied to a bagged spring production equipment.

One of the methods includes: in case of switching from a first steel wire to a second steel wire, controlling, by a controller, a double steel wires coiling machine 10 to suspend the first steel wire being coiled; controlling, by the controller, a second heating mechanism 22 to heat the second steel wire; acquiring, by a second temperature detection mechanism 32, a temperature of the second steel wire in real time and feeding the temperature back to the controller; in response to the temperature of the second steel wire reaching or exceeding a preset temperature, controlling, by the controller, the coiling machine 10 to coil the second steel wire into a spring.

The other method includes: controlling, by a controller, a second heating mechanism 22 to heat a second steel wire while a first steel wire is being coiled into a spring by a double steel wires coiling machine 10; acquiring, by a second temperature detection mechanism 32, a temperature of the second steel wire in real time and feeding the temperature back to the controller, such that the temperature of the second steel wire is always kept within a predetermined range; in case of switching from the first steel wire to the second steel wire, controlling, by the controller, the coiling machine 10 to directly switch from the first steel wire being coiled to the second steel wire and coil the second steel wire into a spring. In this method, the first steel wire and the second steel wire can be directly switched without waiting for the second steel wire to be heated, thus effectively improving the production efficiency.

The controlling, by a controller, a second heating mechanism 22 to heat the second steel wire, such that the second steel wire is always kept within a predetermined range has, but not limited to, two implementations as follows.

In response to the temperature of the second steel wire detected by the second temperature detection mechanism 32 reaching a preset temperature value A, the controller suspends heating of the second steel wire by the second heating mechanism 22, and in response to the temperature of the second steel wire detected by the second temperature detection mechanism 32 being decreased to a preset temperature value B, the controller starts the second heating mechanism 22 to heat the second steel wire, such that the temperature of the second steel wire is always kept between the preset temperature value A and the preset temperature value B.

In the other implementation, the controller adjusts and controls an output current level of the second heating mechanism 22 according to a temperature level of the second steel wire detected by the second temperature detection mechanism 32; in response to a higher temperature of the second steel wire, adjusting the second heating mechanism 22 to heat with a weak current output, and in response to a lower temperature of the second steel wire, adjusting the second heating mechanism 22 to heat with a strong current output, such that the temperature of the second steel wire is always kept within a predetermined range.

The embodiments of the disclosure are described in detail above with reference to the drawings, but the disclosure is not limited to the embodiments above, and various changes may be made within the scope of knowledge possessed by those of ordinary skills in the art without departing from the purpose of the disclosure.

What is claimed is:

1. A method for detecting heating treatment temperatures of double steel wires, comprising the following steps of:

controlling, by a controller, a second heating mechanism to heat a second steel wire, while a first steel wire is being coiled into a spring by a double steel wires coiling machine, wherein the first steel wire and the second steel wire is coiled into a first spring and a second spring by the coiling machine respectively, acquiring, by a second temperature detection mechanism, a temperature of the second steel wire in real time and feeding the temperature back to the controller, such that the temperature of the second steel wire is always kept within a predetermined range, and in case of switching from the first steel wire to the second steel wire, controlling, by the controller, the coiling machine to directly switch from the first steel wire being coiled to the second steel wire and coil the second steel wire into a spring.

2. The method of claim 1, wherein controlling, by a controller, a second heating mechanism to heat a second steel wire, comprising:

in response to the temperature of the second steel wire detected by the second temperature detection mechanism reaching a preset temperature value A, controlling, by the controller, the second heating mechanism to suspend heating of the second steel wire, and in response to the temperature of the second steel wire detected by the second temperature detection mechanism being decreased to a preset temperature value B, activating, by the controller, the second heating mechanism to heat the second steel wire, such that the temperature of the second steel wire is always kept between the preset temperature value A and the preset temperature value B.

3. The method of claim 1, wherein controlling, by a controller, a second heating mechanism to heat a second steel wire, comprising:

adjusting and controlling, by the controller, an output current level of the second heating mechanism according to a temperature level of the second steel wire detected by the second temperature detection mechanism, such that the temperature of the second steel wire is always kept within a predetermined range.

* * * * *